US008782964B1

(12) United States Patent
Neri

(10) Patent No.: US 8,782,964 B1
(45) Date of Patent: Jul. 22, 2014

(54) PRIVACY WALL

(71) Applicant: Frank G. Neri, Vernon, CT (US)

(72) Inventor: Frank G. Neri, Vernon, CT (US)

( * ) Notice: Subject to any disclaimer, the term of this patent is extended or adjusted under 35 U.S.C. 154(b) by 0 days.

(21) Appl. No.: 13/815,424

(22) Filed: Mar. 1, 2013

(51) Int. Cl.
*E04H 4/00* (2006.01)
*E04B 7/00* (2006.01)

(52) U.S. Cl.
USPC ..... 52/79.1; 52/302.1; 52/18; 52/473; 52/549; 52/696

(58) Field of Classification Search
USPC ..... 52/302.1, 79.1, 202, 18, 262, 272, 455, 52/460, 473, 478, 549, 696, 693; 256/25
See application file for complete search history.

(56) References Cited

U.S. PATENT DOCUMENTS 332,491 A * 12/1885 Clay ..... 52/630
1,283,338 A * 10/1918 Simon ..... 52/64
2,680,886 A * 6/1954 Urban ..... 52/78
2,973,943 A * 3/1961 Loter et al. ..... 256/21
3,914,914 A * 10/1975 Jureit et al. ..... 52/632
5,306,210 A * 4/1994 Smit ..... 454/250
5,412,920 A * 5/1995 Hess ..... 52/712
5,639,069 A * 6/1997 McClure ..... 256/25
5,839,233 A * 11/1998 Smit ..... 52/198
5,873,202 A * 2/1999 Parks ..... 52/73
7,134,252 B2 * 11/2006 Thompson ..... 52/712
7,568,319 B2 * 8/2009 Fairbairn ..... 52/473
8,109,044 B2 * 2/2012 Graber ..... 52/36.2
2007/0000200 A1 * 1/2007 Fairbairn ..... 52/473
2013/0205685 A1 * 8/2013 Leatherman ..... 52/79.1

FOREIGN PATENT DOCUMENTS

EP 222456 A2 * 5/1987 ..... F24F 7/02
JP 2001329704 A * 11/2001 ..... E04H 1/12

* cited by examiner

*Primary Examiner* — Brent W Herring
(74) *Attorney, Agent, or Firm* — Ira S. Dorman

(57) ABSTRACT

A wall structure, which may be in the form of a prefabricated unit, provides privacy for an enclosure while also enabling good ventilation. It comprises a planar array of angularly oriented, parallel slats that overlap one another as viewed in a direction generally normal to the plane. The slats are attached to support structure by brackets that are identical to one another.

19 Claims, 7 Drawing Sheets

PRIVACY WALL

BACKGROUND OF THE INVENTION

The interiors of enclosures of various kinds will commonly require ventilation, and when they are intended for human use it is often important that privacy screening against visual intrusion be afforded as well. Leaving doors and windows open to permit air flow may compromise privacy, however, as may the provision of natural light-admitting skylights.

While it is of course old and well known to mount louver boards in windows and other openings for the purpose of enabling air flow and light admittance (while also serving to shed rainwater), considerable effort and skill is required for making such installations, particularly if they are to be functionally optimal and aesthetically pleasing. As far as is known, no wall structure for ventilating an enclosure, while also affording privacy against visual intrusion, has heretofore been provided, such structure being facile and economical to construct, aesthetically attractive, and highly effective for its intended purposes.

BRIEF SUMMARY OF THE INVENTIONS

Accordingly, objects of the present invention are to provide an enclosure that includes wall structure that enables ventilation of the interior while affording privacy against visual intrusion, and also to provide such a wall structure.

More specific objects are to provide an enclosure and a wall structure having the foregoing features and advantages, wherein the wall structure is facile and economical to build and manufacture, is aesthetically attractive, and is highly effective for its intended purposes.

It has now been found that certain of the foregoing and related objects of the invention are attained by the provision of an enclosure comprised of a multiplicity of walls, at least one of the walls being constructed for visual screening and ventilation of the interior of the enclosure. The "one" wall is generally planar, and is comprised of a first multiplicity of slats; a plurality of substantially rectilinear support beams spaced laterally from one another; a second multiplicity of identical slat-mounting brackets; and means for fastening the slats to the brackets and the brackets to the beams. Each of the slat-mounting brackets is comprised of a generally planar panel portion of parallelogrammic configuration, and has first and second edges that form supplementary acute and obtuse angles, respectively, with a common third edge to which the first and second edges are adjacent. Each bracket also has at least one flange element that extends perpendicular to the panel portion along each of the first, second, and third edges thereof. First and second pluralities of the brackets are fastened by the means for fastening, coacting with the at least one flange element along the third edges of the brackets, to first and second ones of the support beams, respectively, with the panel portions of the first plurality of brackets lying substantially in a first common plane with the first support beam and with the panel portions of the second plurality of brackets lying substantially in a second common plane with the second support beam, each of the brackets on the first beam being aligned laterally with a bracket on the second beam to provide a multiplicity of pairs of brackets spaced laterally from one another. Each of the bracket pairs is fastened by the fastening means, coacting with the at least one flange elements along the first and second edges of the brackets, to two transversely adjacent, parallel slats disposed against the at least one flange elements along the first and second edges of the brackets. As a result, the slats are affixed in mutually parallel assembly extending transversely to the rectilinear axes of the support beams and with an interior angle between the slats and the support beams having the value of the acute angle, and overlapping one another as viewed in a direction normal to the plane of the wall. Normally, the support beams will be substantially coplanar, and parallel to one another.

In preferred embodiments, each bracket will be integrally formed, as a single piece, and the at least one flange elements, along both the first and second edges of the bracket, will extend in the same direction from the panel portion thereof, as will the at least one flange element that is provided along the third edge of the bracket; a second flange element along the third edge of the bracket will desirably extend from the panel portion in the opposite direction as well. A brace piece will advantageously be affixed to each of the support beams and fastened interiorly to an endmost one of the multiplicity of slats comprising the one wall, on a face thereof opposite to the face against which the mounting brackets bear. The slats will typically be about three to six inches in width, but can be wider or narrower as appropriate to suit a given application or structural requirement. The slats and the beams will typically be made of wood, but plastics, composite materials, and the like can be utilized as well. The brackets will typically be of stamped metal construction; the acute angle at which the "first" edge of each bracket is formed will normally have a value of about 30° to 60°.

Additional objects of the invention are attained by the provision of a screening and ventilating wall unit, constructed as hereinabove and hereinafter described.

DETAILED DESCRIPTION OF THE INVENTION

Figure 1:
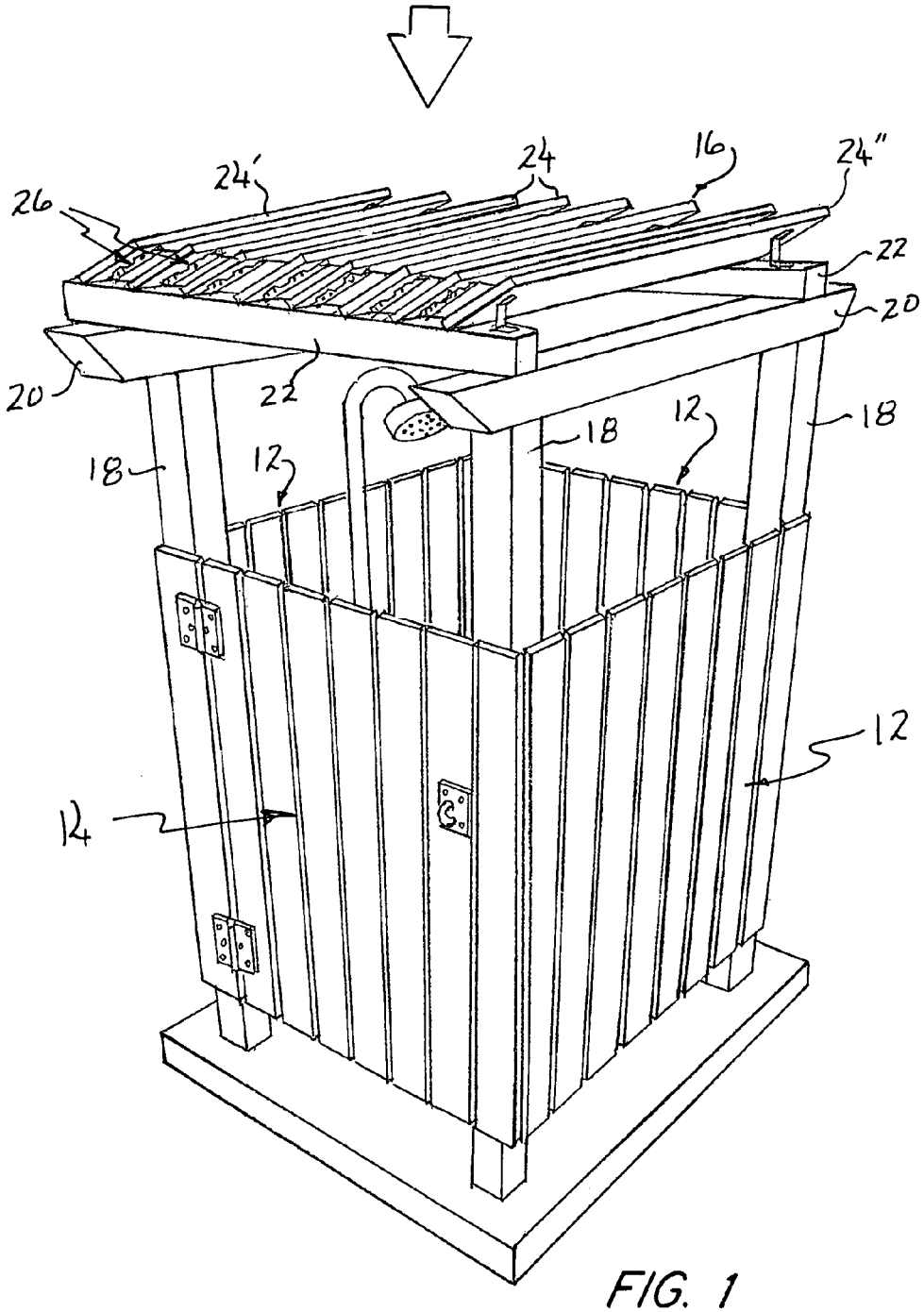
FIG. 1 is a perspective view of an enclosure embodying the present invention, incorporating a screening and ventilating roof (i.e., a top wall), provided in accordance herewith.

Turning now in detail to the appended drawings, FIG. 1 depicts a shower enclosure embodying the present invention. The enclosure consists of three sidewalls, each generally designated by the numeral 12, a door 14, and a roof or top wall unit, generally designated by the numeral 16. The side walls, door, and roof are supported by and upon four vertical corner posts 18, and a header 20 spans two of the posts on each side of the enclosure, the headers 20 being disposed in coplanar, parallel relationship to one another and providing direct underlying support for the roof unit 16.

Figure 2:
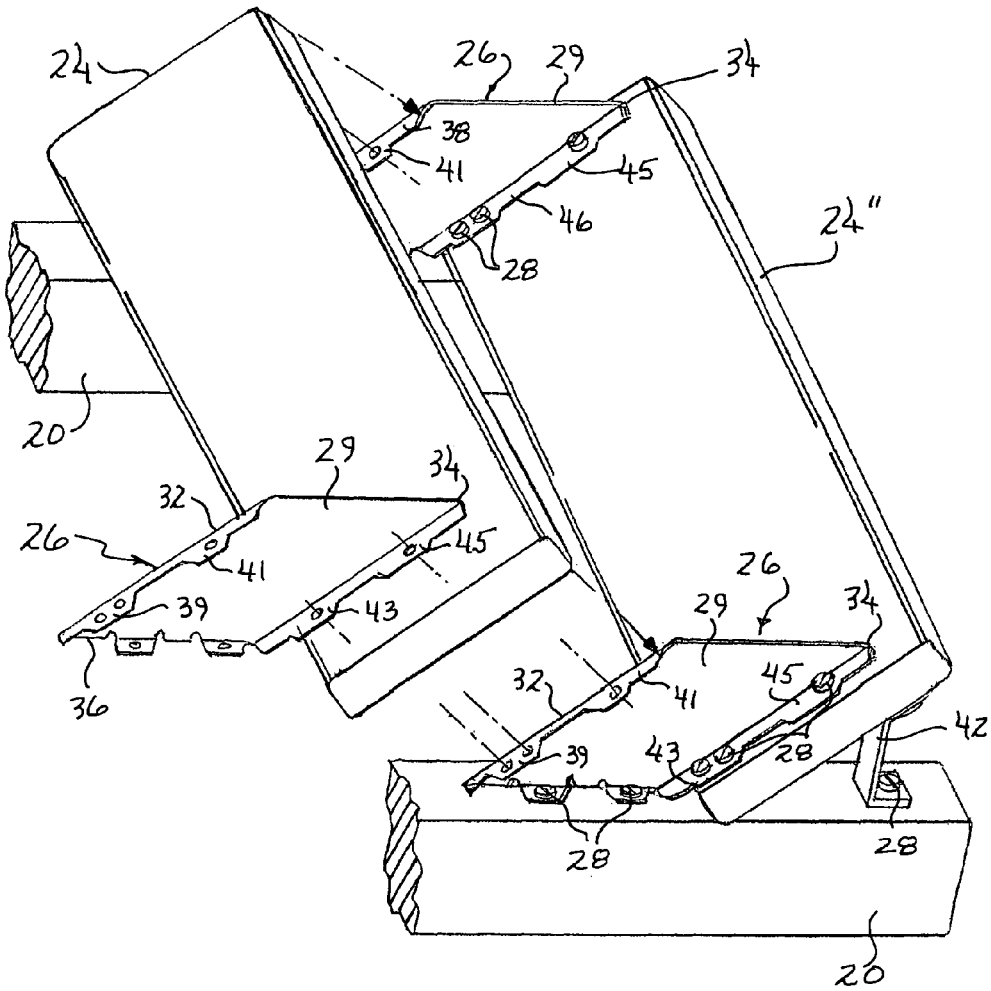
FIG. 2 is a fragmentary, exploded perspective view of a unit providing the roof of the enclosure of FIG. 1, drawn to an enlarged scale.
Figure 3:
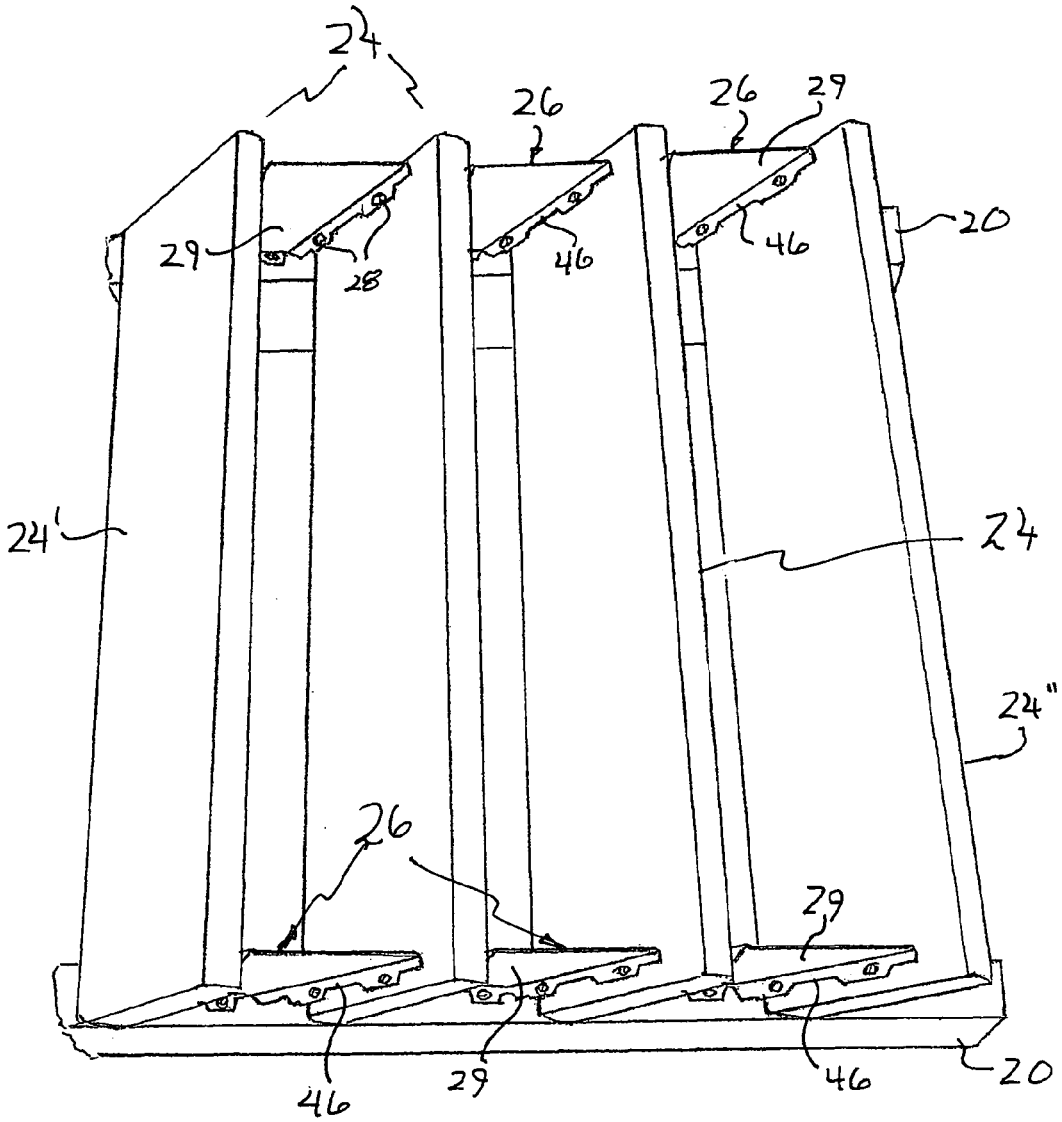
FIG. 3 is a fragmentary, perspective view of the roof unit of FIGS. 1 and 2, drawn to a scale reduced from that of FIG. 2.
Figure 4:
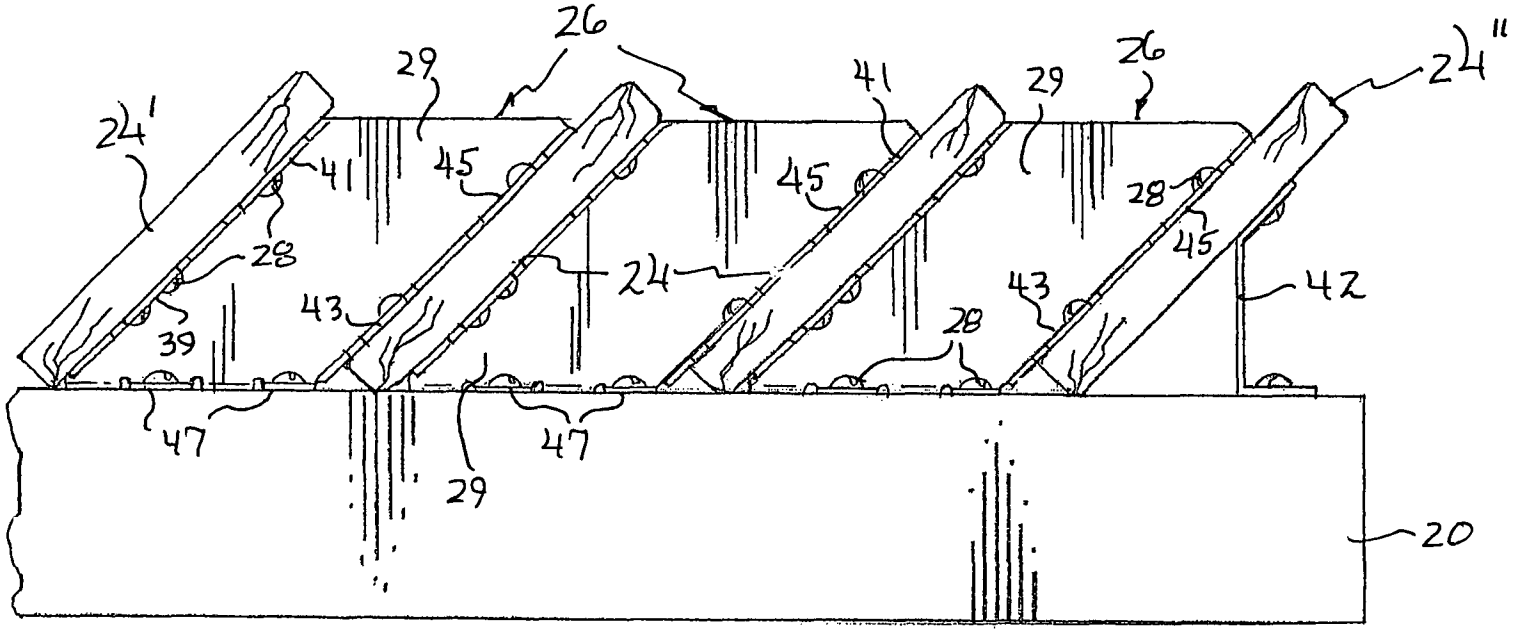
FIG. 4 is a fragmentary end elevational view of the roof unit, drawn to a scale slightly enlarged from that of FIG. 2.

As can best be seen with additional reference to FIGS. 2 through 4, the roof unit 16 comprises a pair of laterally spaced, coplanar and parallel support beams 22, and a multiplicity of slats 24. The slats 24 extend transversely of the support beams 22 and parallel to one another (and to the headers 20), at equidistantly spaced intervals along the length of the beams 22. Each slat 24 (other than the endmost ones) is mounted front and back and at its opposite ends by pairs of mounting brackets, each bracket being generally designated by the numeral 26 and being affixed thereto by fastening screws 28 received through apertures provided; apart from insignificant variations that might occur (e.g., in manufacturing), the brackets 26 are identical to one another.

Figure 5:
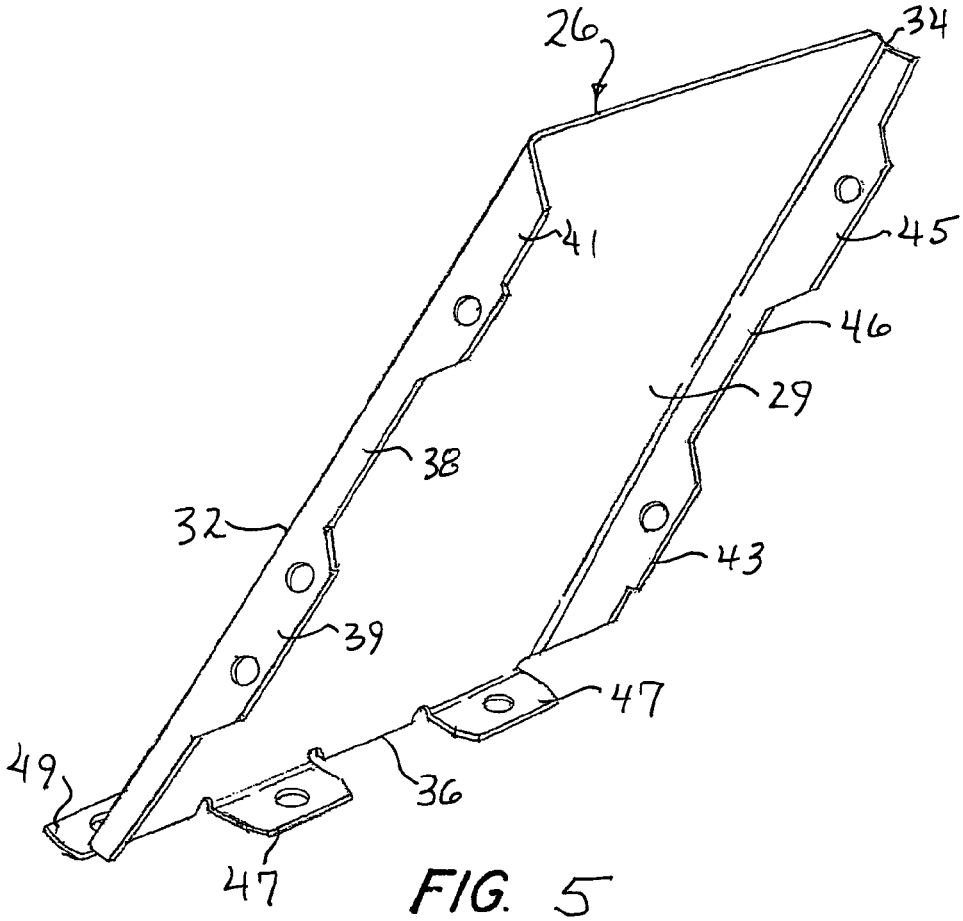
FIG. 5 is a perspective view of a bracket comprising a component of the roof and unit of the foregoing figures, drawn to a greatly enlarged scale and taken from one side.
Figure 6:
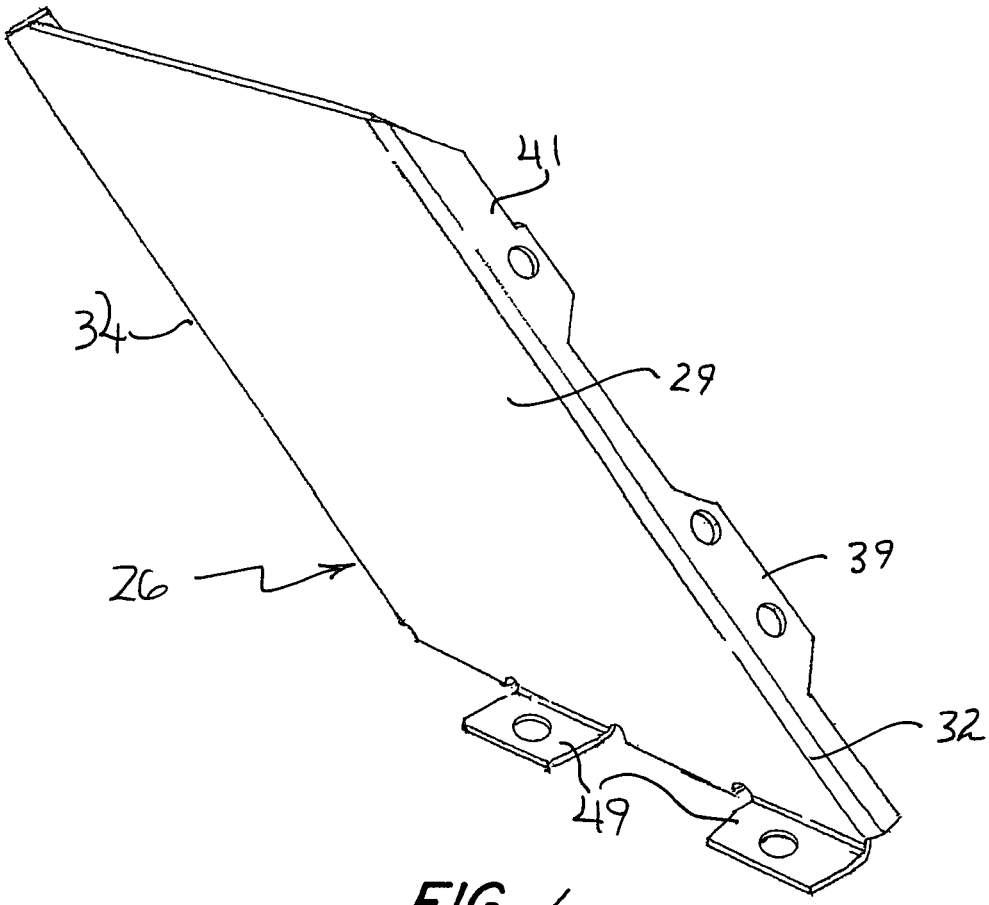
FIG. 6 is a view of a bracket, similar to that of FIG. 5 but taken from the opposite side.
Figure 7:
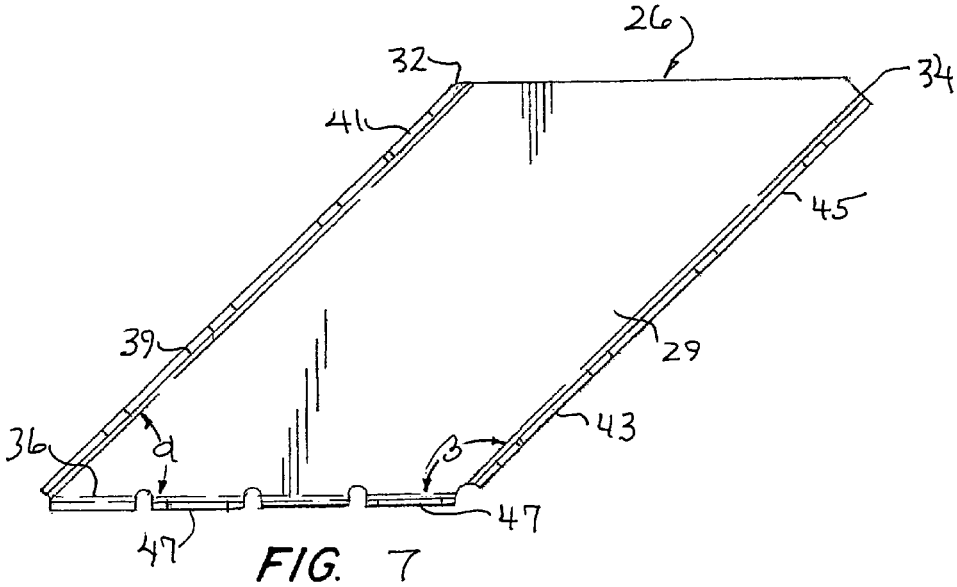
FIG. 7 is an elevational view of the bracket, taken from the same side as in FIG. 5.
Figure 8:
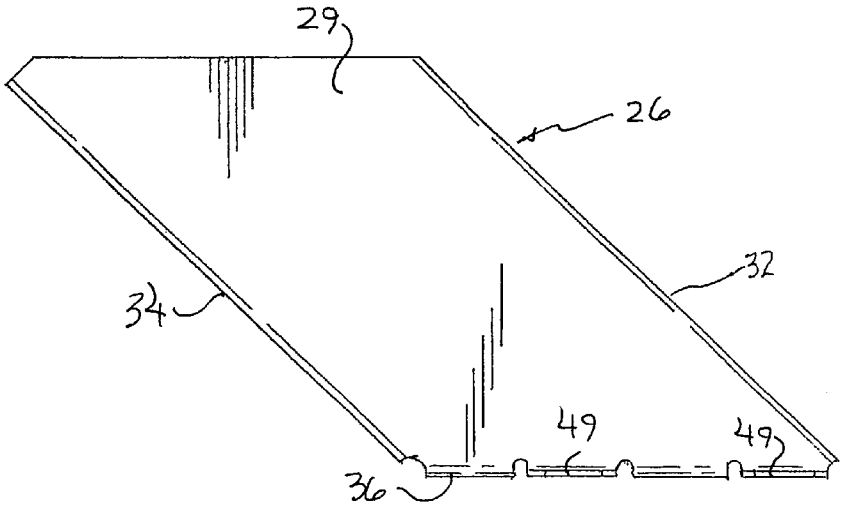
FIG. 8 is a view similar to that of FIG. 7, taken from the same side as in FIG. 6.

As best seen with additional reference to FIGS. 5 through 8, the brackets 26 are of one-piece construction, each consisting of a generally planar main portion 29 of parallellogrammic configuration and having first and second edges 32, 34, respectively, angularly disposed relative to a common third edge 36; the edges 32 and 34 are of course parallel to one another and define supplementary included angles α and β, respectively, with the common edge 36. Two flange elements 39, 41 are formed in flange portion 38, and two flange elements 43, 45 are formed in flange portion 46; the flange portions 38, 46 extend in a first direction from each edge 32, 34. In addition, two flange elements 47 extend in the same, first direction from the common edge 36 and, as is best seen in FIGS. 5, 6, and 8, two additional flange elements 49 extend in the opposite direction from the common edge 36. All flange elements are formed with at least one aperture 48 for receiving the screws 28; other fasteners, such as nails, rivets, and staples may of course be substituted.

A multiplicity of brackets 26 (three are depicted in FIGS. 3 and 4, seven are depicted in FIG. 1) are attached at equidistantly spaced locations, and facing in the same direction, along the length (i.e., along the rectilinear axis) of each support beam 22 using flange elements 39, 41, 43, 45, 47 and 49 and screws 28. The brackets 26 are arranged as laterally aligned pairs, with the multiplicity of brackets on each support beam 22 being disposed in the plane thereof. Consequently, each slat 24 (other than the endmost ones) is affixed on its opposite faces to the flange portions 38, 46 of transversely adjacent pairs of brackets 26, so that the multiplicity of slats 24 extend in parallel relationship to one another and at the interior angle α relative to the support beams 22.

The slat 24', at what might be considered the forward end of the unit, is attached on its back face only and to just a single pair of laterally aligned brackets 26 at its opposite ends; the slat 24" at the opposite end of the unit is similarly attached on its front face only. Added support for the array of slats is provided by attaching a pair of right-angle braces 42 to the beams 22 and to the back face at the opposite ends of the other endmost slat 24", the tops of the braces 42 being bent to accommodate the angular slat orientation.

As will be appreciated, the roof unit 16 will provide privacy to the interior of the enclosure when viewed from above, while affording good ventilation and permitting light to enter the enclosure. It will also be appreciated that one or more of the sidewalls 12 and the door 14 of the enclosure (as well as, or instead of, the roof) may be constructed using similar units or assemblies, and employing a privacy wall structure as a vertical (e.g., sidewall or door) component will often provide more practical benefit than employing it as a top wall. In any event, the slats will be dimensioned and oriented to provide substantial privacy when viewed in a direction normal to the plane of the wall (i.e., in the direction depicted by the open arrow in FIG. 1), as well as throughout some range of angles displaced therefrom; the range of screening will of course depend upon the widths, spacings, and angular orientations of the slats.

As noted above, the slats, supporting beams, and headers will usually be made of wood, albeit other materials of construction, such as plastics and composites, may be employed if so desired. The slats will usually be about three to six inches in width (more or less, as mentioned above) and, needless to say, they may be of any desired length; additional members may be necessary however to provide intermediate support if the slats exceed a certain length. The brackets will conveniently be of stamped-metal construction, but here again fabrication may vary, as desired (e.g., the brackets may be molded plastic pieces); angle α will typically have a value of about 30° degrees to 60° (the supplemental angle β therefore having a typical value of 150° to 120°).

As will be appreciated, the facility, convenience, and economy of assembly and manufacture of the walls and wall units described herein is attributable largely to the structure of the brackets, which are not only readily attached to the slats and supporting beams, to automatically position the slats at a desired angular orientation, but are moreover all identical to one another (within manufacturing tolerances and other insignificant variations). Economy and convenience are also afforded by enabling the mass-production of the privacy walls as units and in modular form, for on-site incorporation into enclosure structures.

Thus, it can be seen that the present invention provides an enclosure comprised of wall structure that enables ventilation of the interior while affording privacy against visual intrusion; the invention also provides such a privacy wall, per se. The wall structure is facile and economical to build and manufacture, it is aesthetically attractive, and it highly effective for it intended purposes.

Having thus described the invention, what is claimed is:

1. An enclosure comprised of a multiplicity of walls, at least one of said walls being constructed for screening and ventilating the interior of said enclosure; said at least one wall being generally planar and comprised of a multiplicity of slats, a plurality of substantially rectilinear support beams spaced laterally from one another, a multiplicity of identical slat-mounting brackets, and means for fastening said slats to said brackets and said brackets to said beams; each of said slat-mounting brackets being comprised of a generally planar panel portion of parallelogrammic configuration and having first and second edges that form supplementary acute and obtuse angles, respectively, with a common third edge to which said first and second edges are each adjacent, said each bracket having at least one flange element, extending perpendicular to said panel portion along each of said first, second, and third edges thereof; first and second rows of said brackets being fastened by said means for fastening, coacting with said at least one flange element along said third edges of said brackets, to first and second ones of said support beams, respectively, with said panel portions of said first row of said brackets lying substantially in a first common plane with said first support beam and with said panel portions of said second row of brackets lying substantially in a second common plane with said second support beam, each of said brackets on said first beam being aligned laterally with a said bracket on said second beam to provide a multiplicity of pairs of brackets spaced laterally from one another, each of said bracket pairs being fastened, by said fastening means coacting with said at least one flange element along said first and second edges of said brackets, to two transversely adjacent, parallel ones of said slats disposed against said at least one flange element along said first and second edges of said brackets, said slats thereby being affixed in mutually parallel assembly and extending transversely to rectilinear axes of said support beams and with an interior angle between said slats and said support beams having the value of said acute angle, said slats overlapping one another as viewed in a direction normal to the plane of said one wall.

2. The enclosure of claim 1 wherein said at least one wall is a roof.

3. The enclosure of claim 1 wherein said support beams are substantially coplanar and parallel to one another.

4. The enclosure of claim 1 wherein said each bracket is integrally formed as a single piece.

5. The enclosure of claim 1 wherein said at least one flange elements along both said first and second edges of said each bracket extend in the same direction from said panel portion thereof.

6. The enclosure of claim 5 wherein said at least one flange element along said third edge of said each bracket extends in said same direction from said panel portion thereof.

7. The enclosure of claim 6 wherein a plurality of flange elements extend along said third edge of said each bracket, and wherein a second said flange element along said third edge extends in the direction opposite to said same direction.

8. The enclosure of claim 7 wherein four flange elements extend along said third edge of said each bracket, and wherein two of said four flange elements extending in said same direction alternate with two other flange elements extending in said opposite direction.

9. The enclosure of claim 1 wherein each of said at least one flange element is formed with a fastener-receiving aperture, and wherein said means for fastening comprises a multiplicity of screws.

10. The enclosure of claim 1 additionally including a brace piece affixed to each of said support beams and fastened interiorly to an endmost one of said multiplicity of slats on a face thereof opposite to the face against which said mounting brackets bear.

11. The enclosure of claim 1 wherein said slats and beams are made of wood, and wherein said brackets are of stamped metal construction.

12. The enclosure of claim 1 wherein each of said slats is about three to six inches in width.

13. The enclosure of claim 1 wherein said acute angle has a value of about 30° to 60°.

14. A general planar screening and ventilating wall comprising: a multiplicity of slats, a plurality of substantially rectilinear support beams spaced laterally from one another, a multiplicity of identical slat-mounting brackets, and means for fastening said slats to said brackets and said brackets to said beams; each of said slat-mounting brackets being comprised of a generally planar panel portion of parallelogrammic configuration and having first and second edges that form supplementary acute and obtuse angles, respectively, with a common third edge to which said first and second edges are each adjacent, said each bracket having at least one flange element, extending perpendicular to said panel portion along each of said first, second, and third edges thereof; first and second rows of said brackets being fastened by said means for fastening, coacting with said at least one flange element along said third edges of said brackets, to first and second ones of said support beams, respectively, with said panel portions of said first row of said brackets lying substantially in a first common plane with said first support beam, and with said panel portions of said second row of brackets lying substantially in a second common plane with said second support beam, each of said brackets on said first beam being aligned laterally with a said bracket on said second beam to provide a multiplicity of pairs of brackets spaced laterally from one another, each of said bracket pairs being fastened, by said fastening means coacting with said at least one flange element along said first and second edges of said brackets, to two transversely adjacent, parallel ones of said slats disposed against said at least one flange element along said first and second edges of said brackets, said slats thereby being affixed in mutually parallel assembly and extending transversely to rectilinear axes of said support beams and with an interior angle between said slats and said support beams having the value of said acute angle, said slats overlapping one another as viewed in a direction normal to the plane of said wall.

15. The wall of claim 14 wherein said support beams are substantially coplanar and parallel to one another.

16. The wall of claim 14 wherein said each bracket is integrally formed as a single piece.

17. The wall of claim 14 wherein said at least one flange elements along both said first and second edges of said each bracket, and said at least one flange element along said third edge of said each bracket, extend in the same direction from said panel portion thereof, and wherein a second said flange element along said third edge extends from said panel portion of said each bracket in the direction opposite to said same direction.

18. The wall of claim 14 wherein said slats and beams are made of wood, wherein said brackets are of stamped metal construction, wherein each of said slats is about three to six inches in width, and wherein said acute angle has a value of about 30° to 60°.

19. The wall of claim 14 additionally including a brace piece affixed to each of said support beams and fastened interiorly to an endmost one of said multiplicity of slats on a face thereof opposite to the face against which said mounting brackets bear.

* * * * *